US009309743B2

(12) United States Patent
Willberg

(10) Patent No.: US 9,309,743 B2
(45) Date of Patent: Apr. 12, 2016

(54) DEVICE USED IN THE FORM OF A PACKER OR A TEMPORARY PLUG

(75) Inventor: Dean Willberg, Tucson, CA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1652 days.

(21) Appl. No.: 12/311,200

(22) PCT Filed: Sep. 18, 2007

(86) PCT No.: PCT/RU2007/000503

§ 371 (c)(1),
(2), (4) Date: Jul. 29, 2011

(87) PCT Pub. No.: WO2008/036002

PCT Pub. Date: Mar. 27, 2008

(65) Prior Publication Data

US 2011/0284213 A1 Nov. 24, 2011

(30) Foreign Application Priority Data

Sep. 22, 2006 (RU) ..... 2006133823

(51) Int. Cl.
*E21B 33/134* (2006.01)
*E21B 33/136* (2006.01)
*E21B 33/12* (2006.01)

(52) U.S. Cl.
CPC ..... *E21B 33/134* (2013.01); *E21B 33/1208* (2013.01); *E21B 33/136* (2013.01)

(58) Field of Classification Search
CPC ..... E21B 33/1234; E21B 33/1236; E21B 33/134; E21B 33/136
USPC ..... 166/135, 192, 153, 383, 202
See application file for complete search history.

(56) References Cited

U.S. PATENT DOCUMENTS

| | | | | | |
|---|---|---|---|---|---|
| 1,609,153 | A | * | 11/1926 | Carter et al. | 166/117 |
| 1,631,419 | A | * | 6/1927 | Kinley | 166/63 |
| 1,851,976 | A | * | 4/1932 | Crowther | 277/336 |
| 2,144,026 | A | * | 1/1939 | Park | 277/340 |
| 2,618,344 | A | * | 11/1952 | Turechek et al. | 166/63 |
| 4,258,926 | A | * | 3/1981 | Upton | 277/340 |
| 5,507,345 | A | * | 4/1996 | Wehunt et al. | 166/285 |
| 6,915,845 | B2 | | 7/2005 | Leising et al. | |
| 7,380,600 | B2 | | 6/2008 | Willberg et al. | |
| 7,717,179 | B2 | * | 5/2010 | Rayssiguier et al. | 166/285 |
| 7,795,328 | B2 | * | 9/2010 | Angenendt | 523/179 |

(Continued)

FOREIGN PATENT DOCUMENTS

| | | |
|---|---|---|
| EP | 1757770 A1 | 2/2007 |
| GB | 2413140 | 9/2006 |

(Continued)

OTHER PUBLICATIONS

International Preliminary Report on Patentability and Written Opinion for the equivalent PCT patent application No. PCT/RU2007/000503 issued on Jan. 10, 2008.

(Continued)

*Primary Examiner* — Giovanna C Wright

(57) ABSTRACT

This invention relates to geophysical research techniques, more particularly, to geophysical well logging methods, and may be used to seal near-wellbore formation during logging activities.

16 Claims, 2 Drawing Sheets

(56) References Cited

U.S. PATENT DOCUMENTS

| | | | | |
|---|---|---|---|---|
| 2003/0060374 | A1* | 3/2003 | Cooke, Jr. | 507/200 |
| 2005/0199401 | A1* | 9/2005 | Patel et al. | 166/387 |
| 2007/0227734 | A1* | 10/2007 | Freyer | 166/295 |
| 2010/0270031 | A1* | 10/2010 | Patel | 166/376 |
| 2011/0259611 | A1* | 10/2011 | Erkol et al. | 166/387 |
| 2011/0315402 | A1* | 12/2011 | Popov et al. | 166/386 |

FOREIGN PATENT DOCUMENTS

| | | |
|---|---|---|
| RU | 1199905 | 12/1985 |
| RU | 2018631 | 8/1994 |
| RU | 2049909 | 12/1995 |
| RU | 2162136 | 1/2001 |
| RU | 2186196 | 7/2002 |
| SU | 258199 | 4/1970 |

OTHER PUBLICATIONS

Office Action for the equivalent Mexican patent application No. of MX/a/2009/003043 issued on Apr. 4, 2013.

* cited by examiner

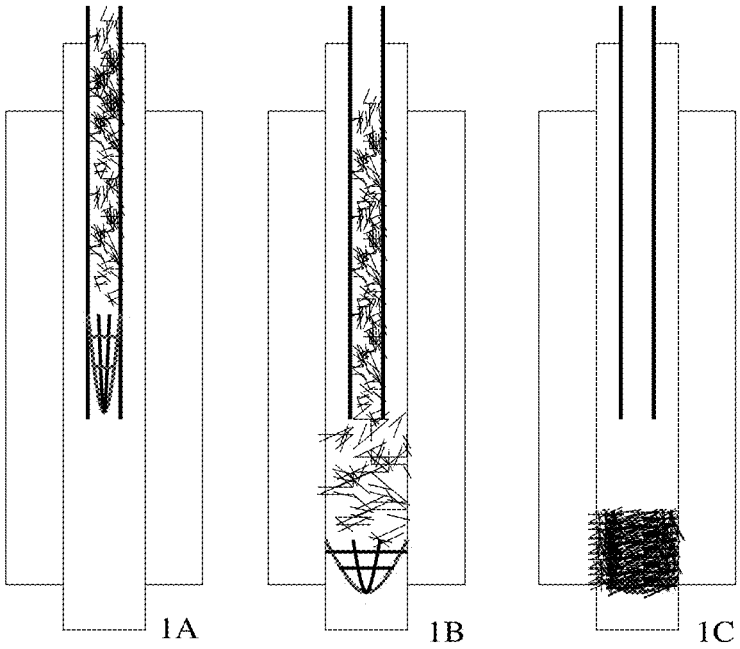
Figs. 1A-C

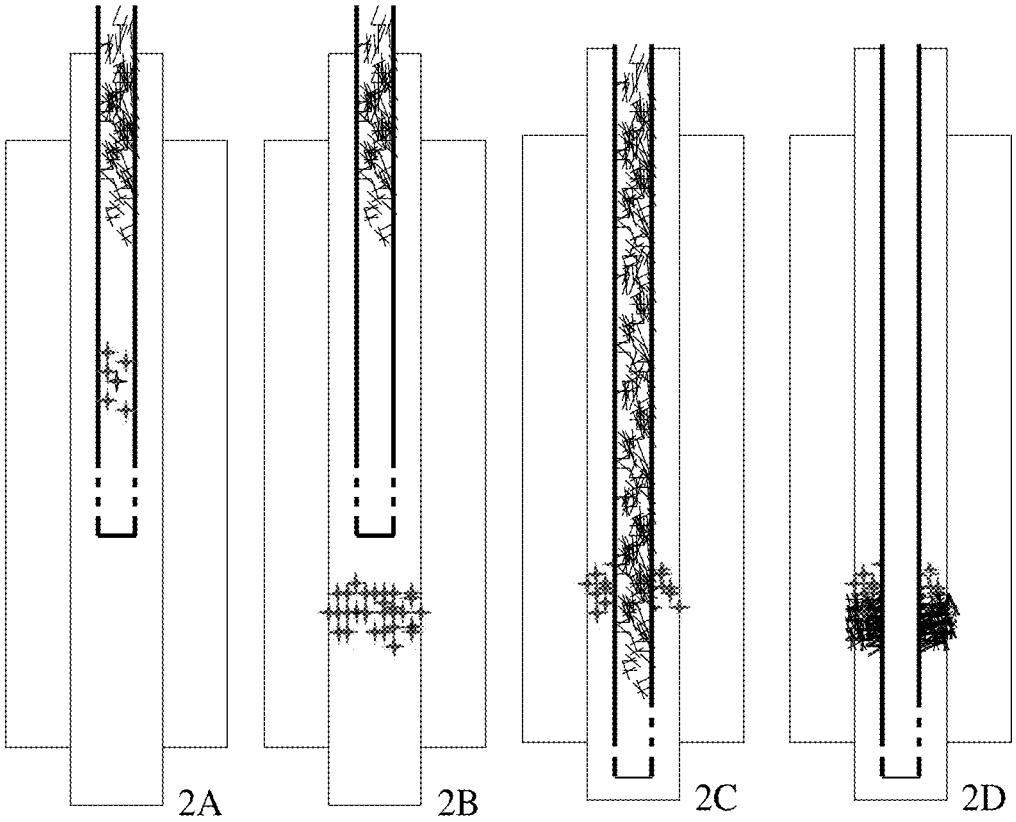
Figs. 2A-D

DEVICE USED IN THE FORM OF A PACKER OR A TEMPORARY PLUG

RELATED APPLICATION INFORMATION

This application claims priority to and benefits from Russian Federation Patent Application serial number 2006133823 filed Sep. 22, 2006.

FIELD

This invention relates to geophysical research techniques. More particularly, the invention is related to geophysical well logging methods, and may be used to seal near-wellbore formation during logging activities.

BACKGROUND

Plug to insulate absorption zone during well drilling consisting of a bend-filamentary filler and a drilled-out load arranged to be located in position is known in the art (RU, Patent 2018631); the bend-filamentary filler is made as a bundle that may be unbent in the cement slurry flow, wherein one end of bend-filamentary filler is rigidly connected with the load to be drilled out The drawbacks of the known plug are the complexity of its structure and complexity of its positioning in the well.

Plug to insulate absorption zone during well drilling consisting of bend-filamentary fillers of various density and a load made of the material to be drilled out is known in the art (RU, Patent 2049909), wherein the fillers contain bands of different sizes and are made as a bundle, one end of the bundle is rigidly connected with the load end part and the fillers with density less than 1 g/cm$^3$ are connected with the load central part and the fillers with density more than 1 g/cm$^3$ are connected with the load periphery. The drawback of the known plug is the complexity of its structure.

The design of a packer consisting of a case made of easily deformable material is known in the art (SU, Patent 1199905); a case-deforming substance (made as blasting charge) as well as a substance impeding liquid passage are placed in the case; the liquid-passage impeding substance is made as a substance hardening at excessive temperatures, and the second substance is porophore.

This engineering solution may be used as closest analogue of the invention proposed. The drawbacks of the known packer are the complexity of its structure and complexity of its positioning in the well.

SUMMARY

In some aspects, the disclosure relates to a device functioning as a packer or temporary plug including a case, and transformable into a device preventing oil-well fluid passage in which the device and a liquid-passage preventing substance is located, wherein the liquid-passage preventing substance is a pack of fibres made of organic or natural polymers and/or glass fibre and the case is made of materials at least low-soluble in the oil-well fluid.

BRIEF DESCRIPTION OF THE DRAWINGS

FIG. 1A illustrates a device delivered to a packer positioning location according to some embodiments of the disclosure.

FIG. 1B illustrates an open case of the device propped against a wellbore wall according to some embodiments of the disclosure.

FIG. 1C illustrates a packer or packer plug formed and isolating a wellbore section according to some embodiments of the disclosure.

FIG. 2A illustrates fibres pumped into a well via a service string according to some embodiments of the disclosure.

FIG. 2B illustrates fibres accumulating on a device making a plug according to some embodiments of the disclosure.

FIG. 2C illustrates fibres accumulating on a case and forming a dense plug according to some embodiments of the disclosure.

FIG. 2D illustrates interaction of fibres with a wellbore surface according to some embodiments of the disclosure.

DESCRIPTION

The engineering problem solved by the proposed packer design consists in making a facility to insulate one or more zones in the well-bore or in the tubing.

The engineering result obtained by the implementation of the design proposed consists in the simplification of the packer in-well positioning technology along with simultaneous reduction of its cost price.

To attain the engineering result stated it is proposed to use a device functioning as a packer or a temporary plug consisting of the case in which liquid-passage preventing substance is located, the said liquid-passage preventing substance is a layer of fibres made of organic polymers and/or glass fibre and the case is made of materials at least low-soluble in the oil-well fluid. In the preferred embodiment of the invention, the case is configured as an integral unit with the in-well expansion option. It facilitates the device in-well positioning process. When the case is configured as an integral unit in the most preferred embodiment, the device additionally includes a facility ensuring case expansion in the well which is a spring crimped-core-hinged or hinged umbrella mechanism (similar devices are highlighted in U.S. Pat. No. 6,915,845).

In one embodiment, a coil (spiral) spring can be used, including the case when both spring ends are connected with each other. After the said device is positioned in the packer or temporary plug zone, it is activated by the action of the spring or hinged umbrella mechanism which ensures the device case opening (FIG. 1). In particular, the device actuation may be ensured by the destruction of the substance holding the spring or hinged mechanism compressed. The destruction is possible, in particular, due to the action of the oil-well fluid on the said retention facility. Also, the device may additionally include a protective housing protecting it during lowering in the drilling string positioned in the well. The said housing is preferably made of easily destructible material, and in case of the device positioning at the temporary plug or packer place the housing is destroyed mechanically or chemically. Hereby, the device case acquires the ability to capture fibres from the liquid column located above. In the preferred embodiment, the case is a wire sphere or rotation body open from the top. The rotation body may be triangular in the longitudinal cross-section, possibly—with rounded angles as well as semi-oval or semi-circle. On the case top surface there additionally may be an element made of permeable cloth, net or perforated material and intended for fibres collection. The said element ensures a more complete fibres collection on the case surface under the fibre gravity force. The case elements may be made of a memory-effect material. It will enable changing the case shape by changing the oil-well fluid temperature.

Also, the case may be made of a material destructible in the wellbore environment. In particular, the elements making up the case may be, at least partially, made of poly-hydroxypropionic acid, poly-glycolic acid, polyethylene terephthalate, polyamides, polyurethanes or mixture of these materials. Besides, the case may be made, at least partially, of material capable to react with the filaments' decomposition products and/or, at least partially, of materials destructible with well flushing fluid (particularly, of aluminium or magnesium or their alloys). All this enables, if necessary, to easily remove the packer or temporary plug by removing (dissolving) the case.

Besides, the case may be made of elements sunk into the well separately which form the said case in the well. In this situation the elements may be sticky-surface fibres and/or fibres interconnecting due to physical (magnetic or electrostatic) interaction.

Fibres included into the liquid-passage preventing substance preferably may be made of poly-hydroxypropionic acid, poly-glycolic acid and glass fibre. The said substance preventing the liquid passage may additionally contain expanding particles, expanding fibres as well as reinforcing fibres. Also the liquid-passage preventing substance may additionally include materials promoting expansion or hardening by making chemical bonds inside the fibres. Further the invention essence will be explained in more detail.

Initially, a flexible or operation tubing, drilling string, service string, sliding sleeve etc is introduced into the well. Via the said elements the device case made as housing-packed and deformed metal, elastomer or plastic frame (particularly, group of polymers like poly-hydroxypropionic acid, polyethylene terephthalate, polyamides, polyaramides, polyphenols) is lowered into the well. The device is delivered to the packer positioning location under pressure via tubing (or into flexible tubing, drilling string, service string or other string), as shown in FIG. 1 A. In another embodiment, the case is lowered on the wireline or auxiliary rope to the actuation location. To prevent early actuation and ensure mechanical protection on the way to the set point, the case is put into a protective housing. The said housing may be made of magnesium, aluminium or plastic (i.e., materials soluble in acid solutions, strong alkali solutions, chemically active solutions or of materials slowly soluble in oil-well fluid). In another embodiment, the housing may be opened using a spring-release mechanism or upon mechanical contact with flexible tubing end. After positioning the case in the packer or temporary plug installation location and/or housing dissolution the case actuation process takes place. The open case props against the wellbore wall which fixes the packer or packer plug position in the well (FIG. 1B). The actuation method depends on the method of its delivery into the well. The case may be actuated using spring release mechanism, gas filling, electric tools, mechanical manipulations with the flexible tubing end, smooth wire, work string, or electromagnetic mechanism. Also the case may be assembled in the well from smaller elements (rods, adhesive fibres, flexible or spring elements, self-assembled magnetic elements (like pre-coat filter formation process)).

After the case actuation a certain amount of drilling mud with suspended fibres is pumped via it. The case is covered with fibres and a dense package is formed that prevents passing oil-well fluid, i.e. packer or packer plug is formed isolating the proper wellbore section (FIG. 1C). Depending on the selection of material to form this device in the wellbore a temporary plug may be obtained (composed of materials subjected to destruction) or permanent plug (made of long-service materials).

Fibre material may be glass, polymers (polyethylene terephthalate, hydroxypropionic acid polymer, polyamides, polyaramides, cellulose and other polymers or homo/co-polymers). Usually fibres are pumped into the well via service string (FIG. 2A). Specific fibres' size is determined by three conditions: first—the possibility to introduce fibres into the drilling mud in ground units, second—the possibility of pumping the suspension obtained via the equipment to the required level, third—the fibres' ability to accumulate on the device making a plug (FIG. 2B). Typical fibres' size is from 3 to 50 mm, but the best is length in the range from 3 mm to 18 mm. These fibres' diameter is from 3 micron to 1 mm. Pump-through conditions are selected to make the fibres accumulate on the case and form a dense plug (FIG. 2C). Due to increased pressure the packer/plug formed is more tightly pressed against the wellbore wall, which is partially attained due to the interaction of these fibres with the wellbore surface (FIG. 2D).

If a temporary plug/packer is required, the material selection depends on its ability to be destroyed in the oil-well fluid. A good example of such a material are fibres produced from hydroxypropionic acid polymer. Polyethylene terephthalate acid demonstrates good performance at high temperatures. To speed up temporary packer replacement, acid flushing is used (mineral and organic acids mixture) or alkaline flushing of sodium hydrate which is pumped into the wellbore.

To make a permanent plug/packer thermally stable fibres are to be used. A good example is glass fibre or novoloid fibres. To make temporary or permanent plugs, combinations of the said fibres may be used or materials improving the packer or plug performance may be added. E.g., glass fibre normally has a high Young modulus, consequently, glass fibre is mechanically stronger in the well conditions than polymer fibres with the same diameter (polyethylene terephthalate or hydroxypropionic acid polymer).

In particular, glass fibre normally is easier captured and accumulated on the device's open frame, but a softer hydroxypropionic acid is better deformable and promotes easier pressurized channel plugging.

Application of the engineering solution proposed enables attaining the following advantages.

For numerous well activities insulation of one or more zones in the well or pipe is required. Sometimes the insulation plays a supportive role—it is required to facilitate another well activity and then the temporary plug must be removed. That is, one well section is insulated first and then the main activity is performed, after which the temporary plug that ensured the insulation is removed. In many cases the locking device, packer plug or packer formation or removal requires using wireline, wire flexible tubing, work string or drilling pipe more than once.

This invention demonstrates the way a permanent or temporary packer plug or packer may be made in situ using fibre materials. This invention demonstrates that in case of proper case and its geometry selection the fibre plugs required may be formed in situ using standard well tools.

What is claimed is:

1. A device functioning as a packer or temporary plug including a case, and transformable into a device preventing oil-well fluid passage in which the device and a liquid-passage preventing substance is located, wherein the liquid-passage preventing substance is a pack of fibres made of organic or natural polymers and/or glass fibre, wherein the case is expanded in-well by a spring or hinged umbrella mechanism, wherein the case is made of materials at least low-soluble in the oil-well fluid, and wherein the case self-destructs or decomposes in a well environment during a wellbore activity.

2. The device according to claim 1, wherein the device additionally comprises a coil spring mechanism.

3. The device according to claim 1, wherein the device additionally comprises a crimped-core-hinged mechanism.

4. The device according to claim 1, wherein the case is a wire ball.

5. The device according to claim 1, wherein the case is a rotation body opened from the top.

6. The device according to claim 1, wherein the device additionally comprises an element made of permeable cloth, net or perforated material designed for the fibres collection.

7. The device according to claim 1, wherein the case is made of a memory-effect material.

8. The device according to claim 1, wherein the device is made of elements separately lowered or supplied into the well under pressure forming an in-situ frame for capturing fibres.

9. The device according to claim 1, wherein the case is at least partially made of poly-hydroxypropionic acid, polyethylene terephthalate, polyamides, polyaramides, polyphenols or mixture of these materials.

10. The device according to claim 1, wherein the case is at least partially made of a material capable of reacting with decomposition products from fibres present in the wellbore environment.

11. The device according to claim 1, wherein the case is at least partially made of materials decomposed by a well flushing fluid.

12. The device according to claim 1, wherein the device is made of aluminium, magnesium and their alloys, as well as resins.

13. The device according to claim 1, wherein the fibres are made of poly-hydroxypropionic acid, polyethylene terephthalate, polyamides, polyaramides, cellulose or fibre glass.

14. The device according to claim 1, wherein the liquid-passage preventing substance additionally includes expandable particles and/or expandable fibres.

15. The device according to claim 1, wherein the liquid-passage preventing substance additionally includes reinforcing fibres.

16. The device according to claim 1, wherein the liquid-passage preventing substance additionally includes materials promoting the fibres' hardening by making chemical bonds inside the fibres.

* * * * *